US005992466A

United States Patent [19]

Weise

[11] Patent Number: 5,992,466

[45] Date of Patent: Nov. 30, 1999

[54] PLUMBING APPARATUS

[75] Inventor: Gary K. Weise, Irvine, Calif.

[73] Assignee: Thermocraft Industries, Inc, Orange, Calif.

[21] Appl. No.: 08/948,126

[22] Filed: Oct. 9, 1997

[51] Int. Cl.[6] ..... F15D 1/08

[52] U.S. Cl. ..... 138/44; 138/120

[58] Field of Search ..... 138/44, 40, 109, 138/120, 37

[56] References Cited

U.S. PATENT DOCUMENTS

| | | | |
|---|---|---|---|
| 2,415,992 | 2/1947 | Clair | 138/40 |
| 2,676,470 | 4/1954 | Streitz | 138/44 |
| 2,680,715 | 6/1954 | Cook | 138/40 |
| 2,958,334 | 11/1960 | Curtis | 138/40 |
| 3,463,691 | 8/1969 | Martin | 138/149 |
| 3,890,656 | 6/1975 | Mathis | 138/40 |
| 3,946,449 | 3/1976 | Mathis | 138/40 |
| 4,105,721 | 8/1978 | Schliebe | 138/44 |
| 4,240,166 | 12/1980 | Altman et al. | 138/111 |
| 4,271,099 | 6/1981 | Kukla | 138/40 |
| 4,712,812 | 12/1987 | Wier, III | 138/96 T |
| 4,860,796 | 8/1989 | Hagin | 138/90 |

*Primary Examiner*—James F. Hook
*Attorney, Agent, or Firm*—Terry L. Miller

[57] ABSTRACT

A bubble jet fitting for use in a spa provides for a lay-length short enough to allow its installation within a six-inch dam wall. The bubble jet fitting has an outlet portion which in one use provides for solvent welding within a standard size of PVC pipe. A pipe extender has end portions similarly sized and configured to solvent weld within end portions of adjacent pipe sections which are connected through the pipe extender.

13 Claims, 2 Drawing Sheets

FIG. 1.
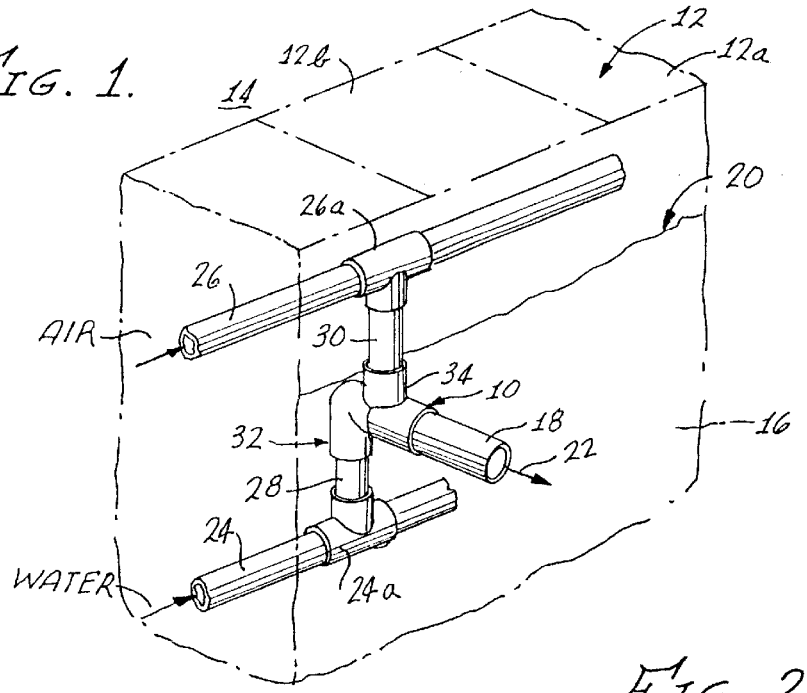
FIG. 2.
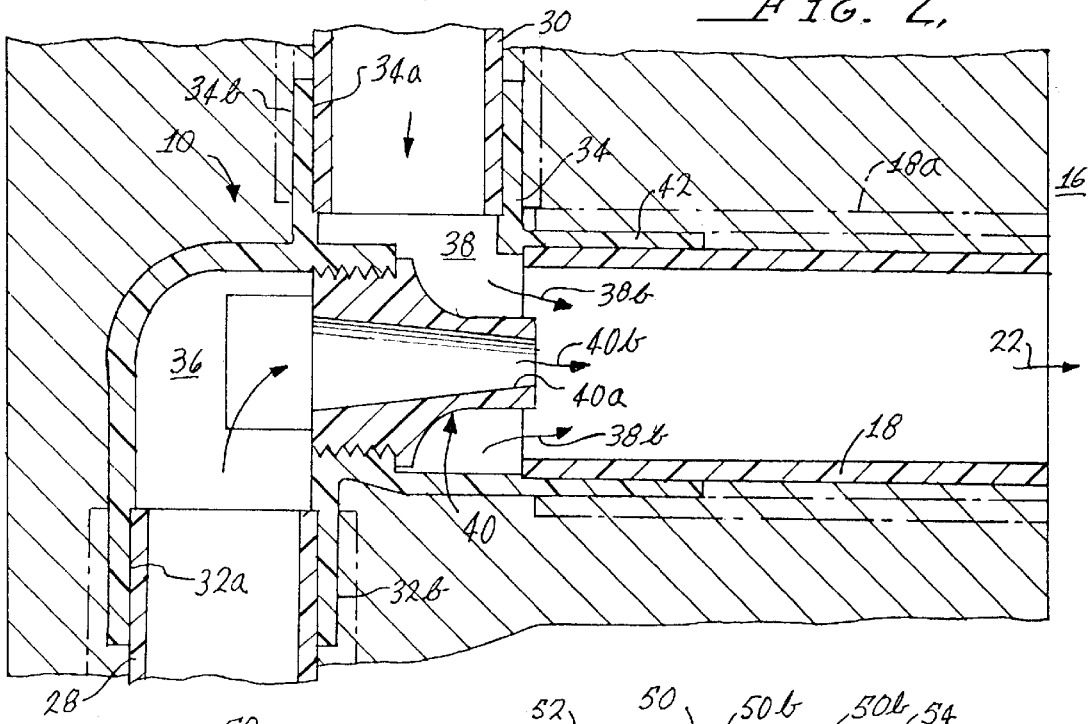
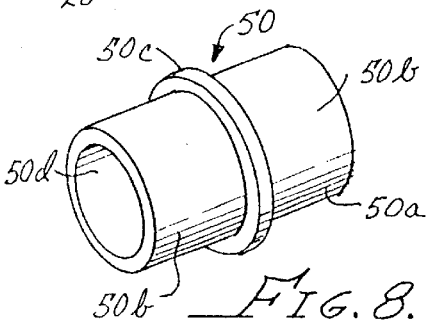
FIG. 8.
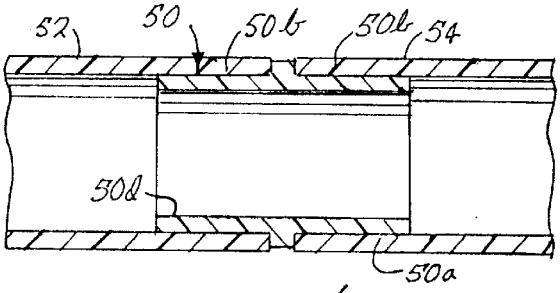
FIG. 9.

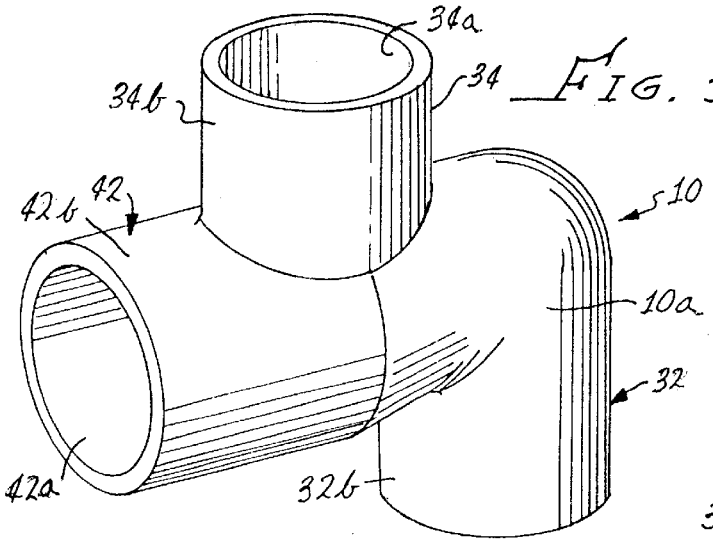
FIG. 3.
FIG. 4.
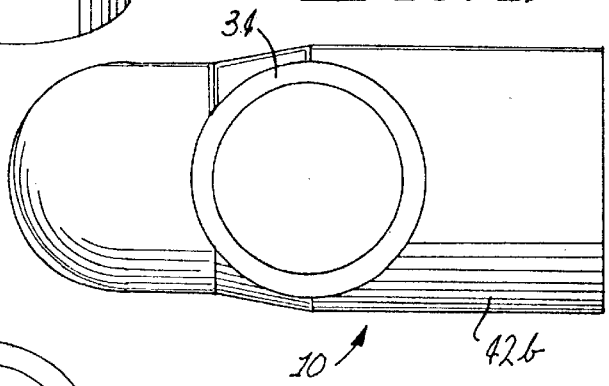
FIG. 7.
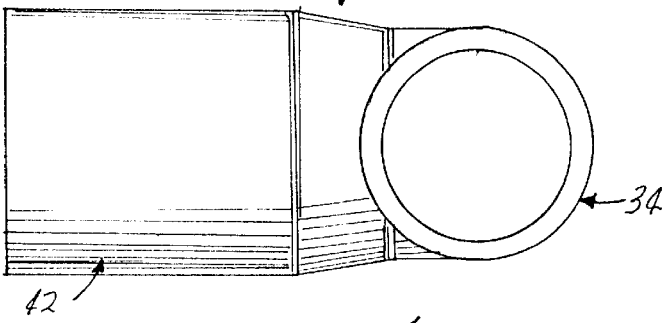
FIG. 6.
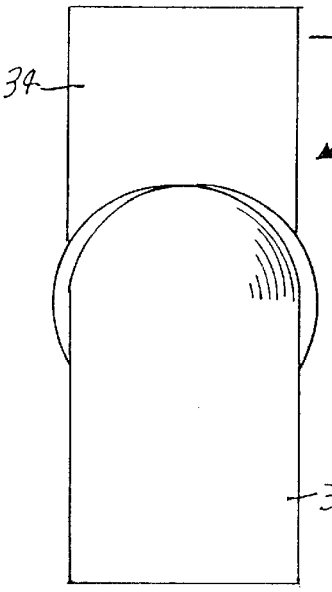
FIG. 5.
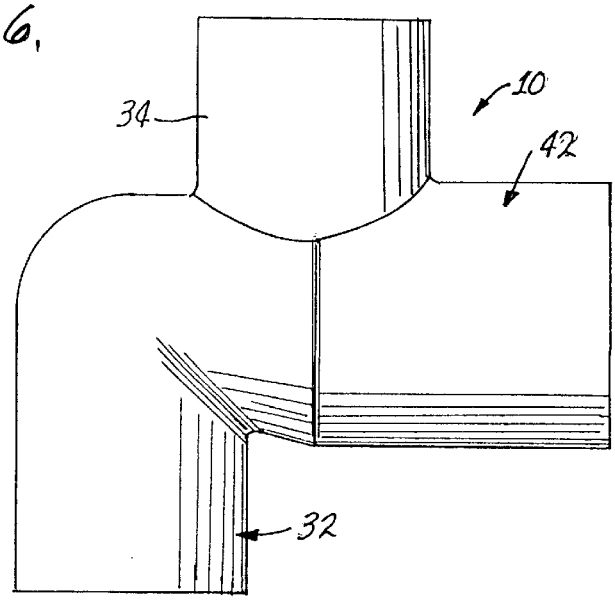

PLUMBING APPARATUS

BACKGROUND OF THE INVENTION

1. Field of the Invention

The present invention is in the field of plumbing apparatus. Particularly, the invention relates to plumbing apparatus designed and made for use with water. Still more particularly, the present invention relates to plumbing fittings configured for solvent bonding with plastic piping to form a water circulation system. The plumbing apparatus is particularly suited to use in connection with a water circulation system of a swimming pool, hot tub, or spa, for example. One embodiment of the present invention provides a plumbing fitting have an advantageously short assembled length with other fittings and pipe.

2. Related Technology

It is conventional in spas and hot tubs to have a pump which draws water from the spa, circulates this water through a heater, and delivers the heated water back to the spa. Particularly at the point or points of introduction of the heated water back into the spa, it is conventional to provide one or more water-powered aspirators. An aspirator of this type is commonly referred to as an "air jet" or a "bubble jet", or just as a "jet", and functions to ingest ambient air. The heated water and air are introduced together into the spa in order to make the spa bubbly. Commonly, the "jet" of bubbly water is introduced into the spa via a pipe stub ending flush with a side wall of the spa. Alternatively, the "jet" is introduced into the spa water via an "eye ball" fitting set into the side wall of the spa. Such "eye ball" fittings allow the jet of water and air to be adjusted to best suit the wishes of the users of the spa, dependent upon the number of people using the spa and the seating locations within the spa water, for example.

In spas which share a water supply with and are adjacent to a pool, it is conventional to have a wall between and common to both the pool and the spa. Such a common shared wall is generally referred to as a "dam wall." The dam wall of a pool/spa is generally only about six inches thick in order to utilize the generally available size of decorative tile. In such cases, the generally available plumbing fittings make it very difficult or impossible to install bubble jets in the dam wall. In order to allow the installation of bubble jets in the dam wall, some pool/spa installations undesirably utilize a dam wall that is thicker than six inches. In such cases, the dam wall may be as thick as nine inches or even twelve inches. Such a thick dam wall necessitates an increase in the materials used to construct the pool/spa, and increases the costs of materials and construction.

It is also conventional to utilize a fitting referred to as a "pipe extender" in order to allow a plastic pipe to be extended, or to be joined to a fitting. The generally available pipe extender is a plastic tubular structure providing a spigot at each of its opposite ends. That is, the pipe extender has a spigot at one end which is to be solvent welded within the end of a plastic pipe. At its other end, the generally available pipe extender includes a spigot section of larger diameter which has the same outside diameter as the plastic pipe. This section of larger diameter forms another spigot which can be solvent welded directly into the socket of a pipe fitting. However, in order to use this pipe extender to actually extend a pipe, a coupling is required. The conventional pipe extender will not directly join two sections of pipe.

SUMMARY OF THE INVENTION

In view of the above, it is desirable and is an object of this invention to provide a bubble jet fitting which is especially configured to allow its use within a six-inch dam wall.

Further, it is an object of this invention to provide such a bubble jet fitting which in a single size of fitting will interface with two different sizes of outlet piping by solvent welding.

Still further, it is an object for this invention to provide a bubble jet fitting which has a water inlet portion and an air inlet portion, each of which is configured to interface with piping of one size and with a plumbing fitting of another size, both by solvent welding.

Additionally, it is an object for this invention to provide a pipe extender which will connect directly two adjacent sections of plastic pipe by solvent welding.

Still further, it is object for this invention to provide such a pipe extender which will solvent weld to the interior surface of adjacent sections of plastic pipe.

Accordingly, the present invention in one embodiment provides A bubble jet fitting for solvent welding with standard PVC pipe and fittings; the bubble jet fitting comprising: a body formed of plastic which may be solvent welded with PVC pipe and fittings; the body defining a water inlet portion leading in a first direction to a water chamber, an air inlet portion leading to an air chamber, a nozzle extending in a second direction substantially perpendicularly to the first direction to direct a jet of water across the air chamber and toward an outlet, and an outlet portion aligning with the nozzle, whereby a jet of water issuing from the nozzle perpendicularly to the first direction entrains air from the air chamber and delivers the air and water together in the second direction to the outlet portion.

Another embodiment of the present invention provides A bubble jet fitting for solvent welding with standard PVC pipe and fittings; the bubble jet fitting comprising: a body formed of plastic which may be solvent welded with PVC pipe and fittings; the body defining a water inlet portion leading in a first direction to a water chamber, an air inlet portion leading in a second direction opposite to and parallel with the first direction to an air chamber, a nozzle extending in a third direction substantially perpendicular to both the first and the second directions to direct a jet of water across the air chamber and toward an outlet, and a tubular outlet portion aligning with the nozzle to accept the jet of water; the tubular outlet portion outwardly defining a cylindrical surface portion sized to be snugly received into and to solvent weld within a PVC pipe, and further defining inwardly a socket sized and configured to accept therein and to solvent weld to an end portion of a PVC pipe; the water inlet portion inwardly defining a socket sized and configured to accept therein and to solvent weld to an end portion of a PVC pipe, and also defining outwardly a surface portion sized and configured to be accepted within and solvent weld into a socket of a PVC pipe fitting; the air inlet portion also inwardly defining a socket sized and configured to accept therein and to solvent weld to an end portion of a PVC pipe, and defining outwardly a surface portion sized and configured to be accepted within and solvent weld into a socket of a PVC pipe fitting; whereby a jet of water issuing from the nozzle perpendicularly to the first direction entrains air from the air chamber and delivers the air and water together in the third direction outwardly of the outlet portion.

Additionally, another embodiment of the invention provides a pipe extender comprising: an elongate tubular body formed of plastic material which can be solvent welded to PVC pipe, the tubular body having a pair of opposite end portions each outwardly defining a surface portion sized and configured to be received into and to be solvent welded within the bore of a PVC pipe.

An advantage of the present invention derives from its provision of plumbing fittings which are especially configured to be solvent welded within a plastic pipe. That is, according to one use of the plumbing fittings provided by the present invention, a fitting embodying the invention is joined to a plastic pipe by having a spigot of the fitting slipped into and solvent welded to an end of a plastic pipe. Another advantage of the bubble jet fitting provided by the present invention is that it can connect to either one of the two most commonly used sizes of outlet piping for use in a spa. In other words, the bubble jet fitting can connect to a 1 and ½ inch pipe by spigoting into the end of the pipe and being solvent welded. On the other hand, the outlet portion of the bubble jet fitting also provides a socket into which an end portion of a one-inch pipe will spigot to be solvent welded.

Similarly, a pipe extender embodying the present invention provides a spigot at each of its opposite ends, which spigots are designed to be received into and to solvent weld to adjacent end portions of plastic pipe. Thus, use of a pipe extender according to the present invention eliminates the need for the use of a conventional pipe extender along with a coupling in order to join two lengths of plastic pipe. Also, the inventive pipe extender may be used to join a length of pipe to a fitting by use of a short nipple of pipe installed between the pipe extender and the fitting. This aspect of the present pipe extender reduces the number of fittings a plumber must carry in order to do most plumbing jobs.

A better understanding of the present invention will be obtained from reading the following description of two preferred exemplary embodiments of the present invention when taken in conjunction with the appended drawing Figures, in which the same features (or features which are analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a fragmentary perspective view, partially in cross section, of a bubble jet fitting embodying the present invention installed in a dam wall of a swimming pool/spa;

FIG. 2 provides a cross sectional view of the bubble jet fitting seen in FIG. 1, and is presented in a larger size for better illustration of features of the fitting;

FIG. 3 provides a perspective view of the bubble jet fitting seen in FIGS. 1 and 2;

FIGS. 4–7 provide orthographic views of the bubble jet fitting seen in FIGS. 1–3, and FIGS. 8 and 9 respectively provide a perspective view and a cross sectional view of a pipe extender embodying the present invention.

DETAILED DESCRIPTION OF EXEMPLARY PREFERRED EMBODIMENTS OF THE INVENTION

Viewing FIG. 1, a bubble jet fitting 10 is seen installed within a dam wall 12. This bubble jet fitting has a body boa, which is preferably formed of plastic to allow it to be solvent welded to standard plumbing fittings and pipe, as will be further explained.

Preferably, the dam wall 12 is only about 6 inches thick. This thickness for the dam wall 12 provides for use on the top surface 12*a* of this wall of standard six-inch decorative tile, which are indicated in phantom lines on FIG. 1 and with the numeral 12*b*. The dam wall 12 forms a boundary between a pool 14 on the far side of this wall 12 as seen in FIG. 1, and a spa 16 on the near side of this wall 12 as seen in FIG. 1. Accordingly, it is seen that the fitting 10 is connected with a pipe stub 18 opening into the spa 16 below the level 20 of the water in this spa. As is indicated by the arrow 22 on FIG. 1, when the bubble jet 10 is operating it discharges a jet of aerated water into the water of the spa 16, and thus makes this spa water bubbly.

Also seen in FIG. 1 is a plastic water pipe 24 and a plastic air pipe 26, each having a respective "T" fitting (24*a* and 26*a*, respectively) interposed therein by solvent welding. The "T" fittings 24*a* and 26*a* allow for connection with the fitting 10. That is, from each "T" fitting 24*a* and 26*a*, a respective short length of plastic pipe 28 and 30 extends vertically each respectively to be solvent welded into a respective water inlet portion 32 and into an air inlet portion 34 of the bubble jet fitting 10. The pipes 24 and 26 generally circumscribe the spa 16 in order to respectively provide both pressurized water (which is usually heated to warm the spa) and ambient air to multiple bubble jet fittings (not shown on FIG. 1) at several locations of the side walls of the spa 16. Because it is generally desirable to locate these bubble jets at differing elevations around the spa 16, the spacing between pipes 24 and 26 will be large enough that the elevations of the jets can be varied by using differing lengths for the pipes 28 and 30. In other words, the pipes 24 and 26 will be further apart vertically than appears to be the case in FIG. 1, which is not to scale.

Viewing now FIG. 2, it is seen that both the water inlet portion 32 and the air inlet portion 34 are configured as dual-function spigot/sockets. In other words, each of these portions inwardly defines a respective socket 32*a* and 34*a*, into which an end portion of the pipes 28 and 30 may be solvent welded as seen in FIG. 2. Also, each of these portions 32 and 34 outwardly defines a generally cylindrical spigot surface 32*b* and 34*b*, which may be received into a socket of a pipe fitting such as a "T" fitting (indicated with dashed lines on FIG. 2) to be solvent welded. The pipe fittings into which the spigot surfaces 32*b* and 34*b* can be solvent welded will be of larger size than the "T" fittings 24*a* and 26*a*. For example, if the pipes 24, 26, 28, and 30 are ¾ inch plastic pipe, then the spigot surfaces 32*b* and 34*b* will be sized to be received into a socket of a standard 1 inch plastic pipe fitting. This dual-function structure for the portions 32 and 34 allows the bubble jet fitting 10 to be installed by plumbers using a wide variety of different pipe and fitting combinations in different sizes. Preferably, the portions 32 and 34 are sized to connect with ¾ inch pipe, and into one-inch fittings.

Still viewing FIG. 2, it is seen that the water inlet portion 32 connects pressurized water from pipe 28 into a water inlet chamber 36, while air inlet portion 34 connects pipe 30 with an air inlet chamber 38. As is seen on FIG. 2, the water inlet portion 32 in essence defines a 90° elbow, and turns the water flow entering from pipe 28 from a vertical flow direction to a horizontal flow direction. From the water inlet chamber 36, a nozzle 40 extends horizontally into chamber 38, and defines an opening 40*a* directing a horizontal jet of water 40*b* across the chamber 38. That is, the bubble jet fitting 10 accepts a vertical flow of water from pipe 28, turns this flow 90° to flow horizontally, and forms a horizontally extending jet 40*b* projecting across air chamber 38. The jet

40*b* of pressurized water projecting across chamber 38 ingests ambient air from this chamber (as is indicated by arrows 38*b* on FIG. 2), and entrains this air in the flow 22 of aerated water flowing to the spa 16.

In order to conduct the flow 22 to the spa 16, the fitting 10 includes an outlet portion 42 aligned with the jet 40*b* and receiving the flow 22. This outlet portion internally defines a socket 42*a* which is sized to receive an end portion of the pipe stub 18. This pipe stub will be solvent welded in socket 42*a*. Alternatively, the bubble jet fitting 10 may also connect at portion 42 to a pipe 18*a* of larger size than pipe 18. In other words, the fitting 10 at portion 42 defines a generally cylindrical surface portion 42*b*, which is sized to fit within and be solvent welded to a pipe 18*a* of larger size than pipe 18. For example, if pipe 18 is of one-inch size, then the surface portion 42*b* will be sized to fit within a 1 and ½ inch plastic pipe.

Importantly, the surface 42*a* of portion 42 is not configured as a spigot sized to fit within the sockets of standard pipe fittings of a particular size. Instead, the surface portion 42*a* is sized to fit snugly into and to be solvent welded within the bore of a standard plastic pipe, in this case a pipe of 1 and ½ size. Preferably, the surface portion 42*b* will have a diameter of about 1.570 inches in order to be received into and solvent weld with the bore of a standard schedule 40 PVC pipe 18*b*. Thus, a user of the fitting 10 is provided with another pair of options for use of different sizes of pipe for installing the bubble jet fitting 10.

Viewing now FIGS. 8 and 9 in conjunction with one another, a pipe extender 50 which makes use of one concept from the bubble jet fitting described above is depicted. In FIG. 8, it is seen that the pipe extender includes an elongate tubular body 50*a*, which is preferably formed of plastic to be solvent welded to plastic pipe. The body 50*a* includes opposite end portions 50*b* which are substantially of the same size and configuration, and a collar portion 50*c* intermediate of the two end portions 50*b*. As FIG. 9 shows, the pipe extender 50 is configured and sized to fit at each of its end portions 50*b* within and to be solvent welded to a respective standard PVC pipe, indicated with numerals 52 and 54. An advantage of joining pipes 52 and 54 by use of the pipe extender 50, rather than by use of a conventional pipe coupling for example, is that the outer diameter of the pipe run including pipes 52 and 54 is not enlarged by pipe extender 50. An advantage which results from this absence of an enlargement on the exterior of the pipes 52/54 is that the pipe run may be threaded though an opening in a wall, for example, without the need to make the opening large enough to pass conventional pipe couplings. Other advantages of the use of pipe extender 50 will occur to those ordinarily skilled in the pertinent arts. It is important to not that the bore 50*d* of pipe extender 50 is somewhat smaller than the bore of pipes 52 and 54, but that this reduction in bore size does not significantly restrict flow in the pipes 52 and 54. Especially this is the case when pipe extender 50 is compared to conventional pipe extenders, it will be seen that a comparable restriction is presented in each case.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. For example, the bubble fitting seen in FIGS. 1–7 is not limited to installation having the water inlet at the bottom and air inlet from above. This fitting can be installed with the water and air inlets extending horizontally (i.e., entering from the sides of the fitting). Accordingly, the depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A bubble jet fitting for solvent welding with standard PVC pipe and fittings; said bubble jet fitting comprising:

a body formed of plastic which may be solvent welded with PVC pipe and fittings; said body defining a water inlet portion defining a vertically extending pipe socket leading in a first direction to terminate in a water chamber, and air inlet portion defining a respective vertically extending pipe socket leading in a second direction which is opposite to and parallel with said first direction to terminate in an air chamber, a nozzle extending from said water chamber in a third direction substantially perpendicularly to said first and second directions to direct a jet of water across said air chamber and toward an outlet, and an outlet portion aligning with said nozzle and defining said outlet, whereby a jet of water issuing from said nozzle in said third direction perpendicularly to said first and second directions entrains air from said air chamber and delivers this air and water together in said third direction to said outlet portion to flow outwardly of said fitting via said outlet; wherein said outlet portion further defines inwardly a socket sized and configured to accept therein and to solvent weld to an end portion of a PVC pipe.

2. The bubble jet fitting of claim 1 in which said outlet portion outwardly defines a cylindrical surface portion sized to be snugly received into and to solvent weld within a PVC pipe.

3. The bubble jet fitting of claim 1 in which at least one of said water inlet portion and said air inlet portion inwardly defines a socket sized and configured to accept therein and to solvent weld to an end portion of a PVC pipe, and said at least one inlet portion also defines outwardly a surface portion sized and configured to be accepted within and solvent weld into a socket of a PVC pipe fitting.

4. A bubble jet fitting for solvent welding with standard PVC pipe and fittings; said bubble jet fitting comprising:

a body formed of plastic which may be solvent welded with PVC pipe and fittings; said body defining a water inlet portion leading in a first direction to a water chamber, an air inlet portion leading in a second direction opposite to and parallel with said first direction to an air chamber, a nozzle extending in a third direction substantially perpendicular to both said first and said second directions to direct a jet of water across said air chamber and toward an outlet, and a tubular outlet portion aligning with said nozzle to accept said jet of water said tubular outlet portion outwardly defining a cylindrical surface portion sized to be snugly received into and to solvent weld within a PVC pipe, and further defining inwardly a socket sized and configured to accept therein and to solvent weld to an end portion of a PVC pipe;

said water inlet portion inwardly defining a socket sized and configured to accept therein and to solvent weld to an end portion of a PVC pipe, and also defining outwardly a surface portion sized and configured to be accepted within and solvent weld into a socket of a PVC pipe fitting;

said air inlet portion also inwardly defining a socket sized and configured to accept therein and to solvent weld to an end portion of a PVC pipe, and defining outwardly a surface portion sized and configured to be accepted within and solvent weld into a socket of a PVC pipe fitting;

whereby a jet of water issuing from said nozzle perpendicularly to said first direction entrains air from said air chamber and delivers the air and water together in said third direction outwardly of said outlet portion.

5. The bubble jet fitting of claim 4 in which said cylindrical surface portion of said outlet portion has an outer diameter of about 1.57 inches.

6. A bubble jet fitting for solvent welding in a position spaced vertically between a pair of opposed vertically-extending standard PVC pipes, in which one of said pair of pipes flows a supply of pressurized water toward and into said fitting and the other of said pair of pipes flows a supply of ambient air toward and into said bubble jet fitting, said fitting comprising: a body defining a water inlet portion with a pipe socket leading vertically in a first direction to terminate in a water chamber, an air inlet portion defining a respective pipe socket leading vertically in a second direction which is opposite to and parallel with said first direction to terminate in an air chamber, a nozzle extending from said water chamber in a substantially horizontal direction perpendicularly to said first and second directions to direct a jet of water across said air chamber and toward an outlet, and an outlet portion aligning with said nozzle and defining said outlet, whereby a jet of water issuing from said nozzle substantially horizontally entrains air from said air chamber and delivers this air together with the water substantially horizontally to said outlet portion to flow outwardly of said fitting via said outlet, and wherein said body further defines at said outlet a socket portion which inwardly defines a socket sized and configured to accept therein and to solvent weld to an end portion of a standard PVC pipe of a first size, and said socket portion outwardly further defines a cylindrical surface sized to be snugly received into and to solvent weld within a PVC pipe of a second size which is larger than said first size.

7. The bubble jet fitting of claim 6 wherein said outlet portion is generally cylindrical and substantially horizontally extending to outwardly define a cylindrical surface portion sized to be snugly received into and to solvent weld within an end portion of a horizontally extending PVC pipe of said second size, and said outlet portion further inwardly defines a horizontally extending pipe socket sized to receive and to solvent weld therein an end portion of a horizontally extending PVC pipe of said first size.

8. The bubble jet fitting of claim 6 wherein at least one of said water inlet portion and said air inlet portion outwardly defines a substantially vertically extending cylindrical surface sized to be received into and be solvent welded to a pipe socket portion of a vertically extending standard PVC pipe fitting.

9. The bubble jet fitting of claim 6 wherein said outlet portion is generally cylindrical and substantially horizontally extending to outwardly define a cylindrical surface portion sized to be snugly received into and to solvent weld within an end portion of a horizontally extending PVC pipe of said second size, and said outlet portion further inwardly defining a pipe socket sized to receive and to solvent weld therein an end portion of a horizontally extending PVC pipe of said first size; and wherein at least one of said water inlet portion and said air inlet portion outwardly defines a substantially vertically extending cylindrical surface sized to be received into and be solvent welded to a pipe socket portion of a vertically extending standard PVC pipe fitting.

10. The bubble jet fitting of claim 9 wherein both of said water inlet portion and said air inlet portion each outwardly defines a respective substantially vertically extending cylindrical surface, said respective vertically extending cylindrical surfaces of both said water inlet portion and of said air inlet portion being sized to be received into and be solvent welded to a respective pipe socket portion of a standard PVC pipe fitting.

11. A bubble jet fitting for solvent welding in a position spaced vertically between a pair of opposed vertically-extending standard PVC pipes, in which one of said pair of pipes flows a supply of pressurized water toward and into said fitting and the other of said pair of pipes flows a supply of ambient air toward and into said bubble jet fitting, said fitting comprising:

a body defining a water inlet portion with a flow path leading vertically in a first direction to terminate in a water chamber, an air inlet portion defining a respective flow path leading vertically in a second direction which is opposite to and parallel with said first direction to terminate in an air chamber, a nozzle extending from said water chamber in a substantially horizontal direction perpendicularly to said first and second directions to direct a jet of water substantially horizontally across said air chamber and toward an outlet, and an outlet portion aligning with said nozzle and defining said outlet;

wherein at least one of said water inlet portion and said air inlet portion outwardly defines a substantially vertically extending cylindrical surface sized to be received into and be solvent welded to a pipe socket portion of a standard PVC pipe fitting; and whereby a jet of water issuing from said nozzle substantially horizontally entrains air from said air chamber and delivers this air together with the water substantially horizontally to said outlet portion to flow outwardly of said fitting via said outlet.

12. The bubble jet fitting of claim 11 wherein said outlet portion is generally cylindrical and substantially horizontally extending to outwardly define a cylindrical surface portion sized to be snugly received into and to solvent weld within an end portion of a PVC pipe of a first size, and said outlet portion further inwardly defines a pipe socket sized to receive and to solvent weld therein an end portion of a PVC pipe of a second size which is smaller than said first size.

13. The bubble jet fitting of claim 11 wherein both of said water inlet portion and said air inlet portion each outwardly defines a respective substantially vertically extending cylindrical surface, said respective vertically extending cylindrical surfaces of both said water inlet portion and of said air inlet portion being sized to be received into and be solvent welded to a respective pipe socket portion of a standard PVC pipe fitting.

* * * * *